US005547198A

United States Patent [19]

Kaiser

[11] Patent Number: 5,547,198

[45] Date of Patent: Aug. 20, 1996

[54] COLORING BOARD GAME AND APPARATUS THEREFOR

[76] Inventor: Ronald A. Kaiser, 12821 McCracken Rd., Garfield Heights, Ohio 44125

[21] Appl. No.: 336,931

[22] Filed: Nov. 10, 1994

[51] Int. Cl.[6] ..... A63F 3/00

[52] U.S. Cl. ..... 273/243; 273/240; 273/276

[58] Field of Search ..... 273/243, 240, 273/276; 434/84, 408, 413

[56] References Cited

U.S. PATENT DOCUMENTS

| | | | |
|---|---|---|---|
| 3,876,207 | 4/1975 | Jones | 273/276 |
| 4,907,807 | 3/1990 | Lee et al. | 273/276 |
| 4,993,717 | 2/1991 | Fiske | 273/243 |

OTHER PUBLICATIONS

"Games Unlimited," Right Brother, 1981.

*Primary Examiner*—V. Millin
*Assistant Examiner*—William M. Pierce
*Attorney, Agent, or Firm*—Donald A. Bergquist

[57] ABSTRACT

Disclosed herein is a game board apparatus that encourages the creativity of a player by providing an erasable surface having permanently printed indicia comprising artwork, illustrations, or illustrative text, some of said indicia defining boundaries for spatial regions on said erasable surface on the game board, which spatial regions are substantially lacking in color, and upon which a player may apply color from a coloring implement as the playing of a game progresses.

6 Claims, 2 Drawing Sheets

COLORING BOARD GAME AND APPARATUS THEREFOR

BACKGROUND OF THE INVENTION

1. Field of the Invention

This invention deals with board games of the type in which each player progresses toward a goal, the attaining of the goal by one player ending the same and establishing that player as the winner. Distinguishing this game and game apparatus from others is that the players use erasable coloring implements to temporarily color the game board as the game progresses.

2. Description of the Prior Art

Board games of various types are well known. Board games in which dice are rolled or in which cards bearing questions that must, be correctly answered and which thus dictate a player's progress toward attaining the goal of the game are also known. Names of such games of this type include MONOPOLY, CLUE, RISK, CHUTES AND LADDERS. These games all utilize game boards that are preprinted in color on a paper-like material, thereby not offering freedom for the expression of a player's creativity.

SUMMARY OF THE INVENTION

Thus, it is an object of this invention to provide a game board apparatus that encourages the creativity of a player by providing an erasable surface having permanently printed indicia comprising artwork, illustrations, or illustrative text, some of said indicia defining boundaries for spatial regions on said erasable surface on the game board, which spatial regions are substantially lacking in color, and upon which a player may apply color from a coloring implement as the playing of a game progresses.

It is an object of this invention to provide a game apparatus kit comprising: a game board apparatus that encourages the creativity of a player by providing an erasable surface having permanently printed indicia comprising artwork, illustrations, or illustrative text, some of said indicia defining boundaries for spatial regions on said erasable surface on the game board, which spatial regions are substantially lacking in color, and upon which a player may apply color from a coloring implement as the playing of a game progresses; and coloring implements selected from the following list: wax crayons, washable-ink markers, and dry-erase markers.

BRIEF DESCRIPTION OF THE DRAWINGS

This invention will be more easily understood by referring to the drawing figures attached hereto, in which.

BEST MODE FOR CARRYING OUT THE INVENTION

Figure 1:
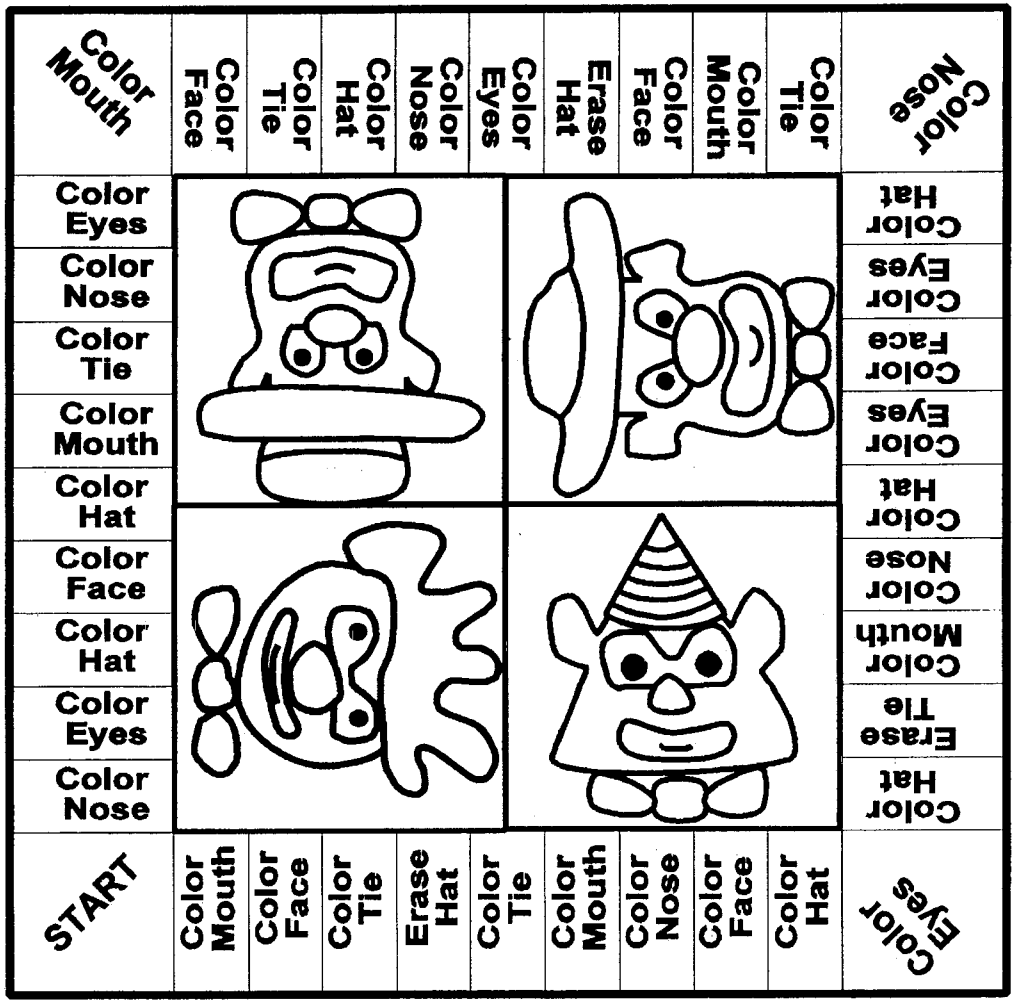
FIG. 1 illustrates a plan view of a coloring board game apparatus of this invention and specifically for a particular game to be played thereon.

In a preferred embodiment of the invention, with specific reference to FIG. 1, there is presented an example of a board game layout, in this case a game called "CLOWN TOWN."

In playing this game, each player has a game token to mark their place on the playing field of the game board. Players in turn roll dice (or use another random-number generator) and move their game tokens the appropriate number of spaces. When their move puts their token on a space having printed instructions, they follow the instructions printed on the playing field. In this version of the CLOWN TOWN game, spaces are marked: "start", "color mouth", "color eyes", "color nose", "color tie", "color face", "color hat".

Each player is assigned one of the outline drawings of a clown on the game board, the outline drawings being substantially devoid of color. A pale tint or half-tone or another device might be used to suggest an appropriate color to be applied to each specific spatial region. When a player's token is moved to a space marked with any instructions beginning with the word "color", that player may use one of their coloring implements to apply color to the spatial region of their clown drawing specified by the instruction. Thus, if the space says "color hat", the player colors his clown's hat. If the space says "color eyes" then the player colors his clown's eyes, and so on In addition, this example shows that some spaces are marked to instruct players to erase certain parts of another player's clown if a player's token lands on these spaces. Whereas the winner of the CLOWN TOWN game is the first player to color in all the spatial regions of their designated clown, effusing color from a portion of an opponent's clown is an advantage for a player.

In more general terms, FIG. 1 represents a board game apparatus, acting as a playing field having permanently-marked spaces constituting a path, a course, or a circuit extending around the board, said path affording a continuous track for the purpose of continuity of play. Certain areas of tile board have permanently-printed thereon artwork and illustrative text defining boundaries for spatial regions, said spatial regions being substantially devoid of artwork, illustrative text, and color, and to which spatial areas the players are to provide color by using coloring implements such as crayons, washable-ink markers, or dry-erase markers. The color thus applied may later be erased with a cloth or paper towel, either moist or dry.

The board itself is made of a paper-like material with a protective plastic-like coating so a person can use crayons, washable-ink markers, or dry-erase markers to mark, draw, or apply color thereon and the color will not penetrate the coating; therefore, it can be wiped off without leaving a residue.

Figure 2:
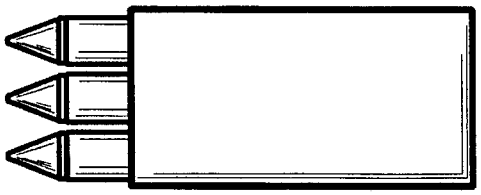
FIGS. 2 and 3 illustrate a box of variously-colored dry-erase markers, washable-ink markers, or wax crayons.
Figure 3:
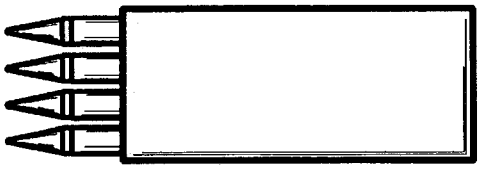

A game apparatus kit would include the board itself, as has been described, and a set of variously colored crayons, washable-ink markers, or dry-erase markers, as is illustrated in FIGS. 2 and 3. Also included in such a kit would be game tokens and a random-number generator, such as a pair of dice or a spinner, used to indicate the number of spaces a player is to move his token on the playing field; such items are commonly used in board games and as such are not a part of the present invention. An erasing medium, such as cloth or paper towels may, optionally, be made a part of the kit, as may be play money or other reward device for the players, these items also not being novel to this invention.

Figure 4:
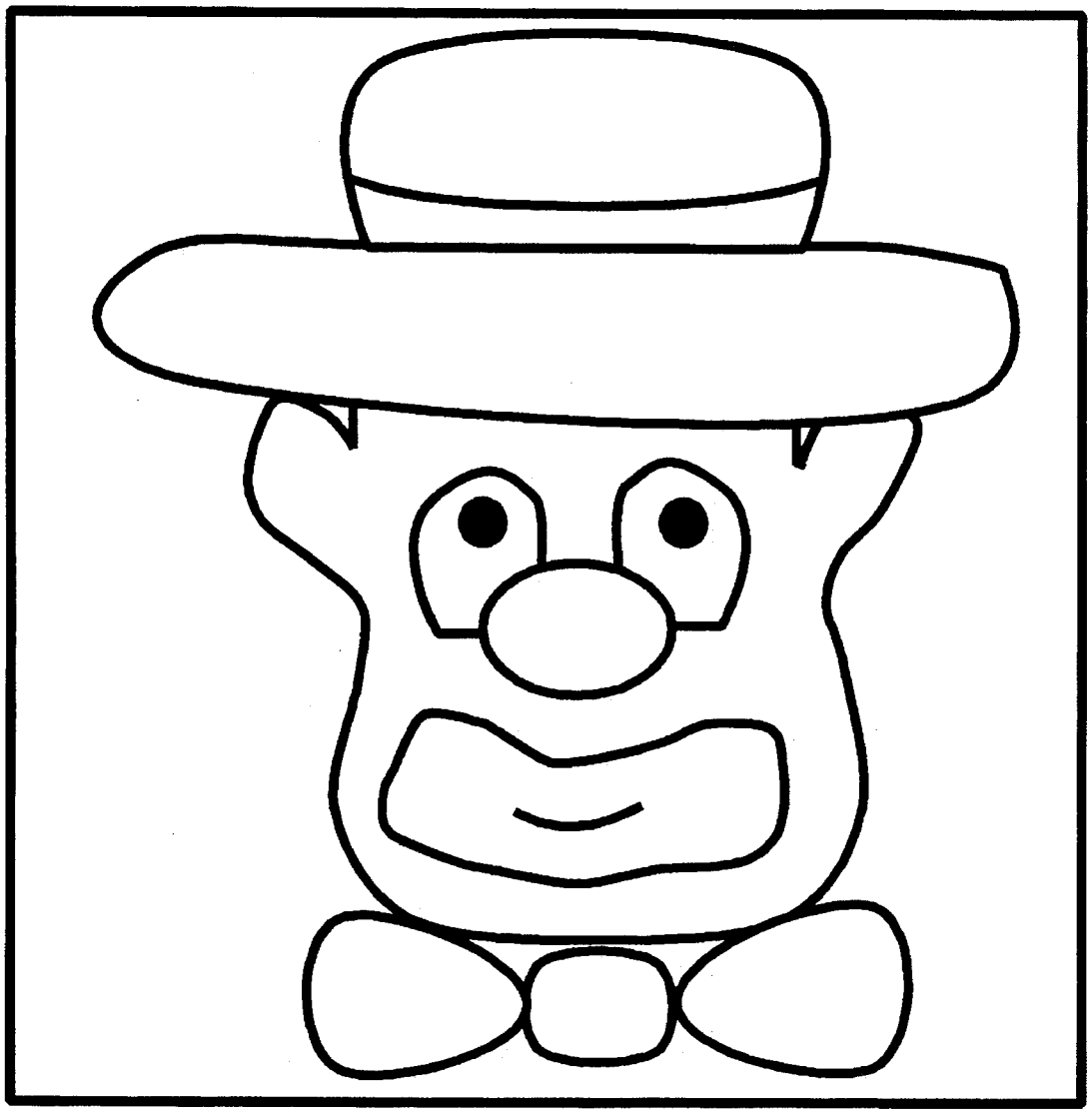
FIG. 4 illustrates a portion of a game board having indicia defining boundaries for spatial regions on said erasable surface on the game board, which spatial regions are substantially lacking in color, and upon which a player may apply color from a coloring implement.

FIG. 4 illustrates a separate sheet of paper like material having permanently printed thereon indicia comprising artwork, illustrations, or-illustrative text, some of said indicia defining boundaries for spatial regions on said paper-like material, which spatial regions are substantially lacking in color, and upon which a player may apply color from a coloring implement. This separate sheet may be used as an adjunct to the game board of this invention in which case the coloring instructions required by the play of the game are done on such separate sheet rather than on the game board. This separate sheet may have an erasable surface or it may be subject to permanent coloring by a player as the playing of a game progresses. This is then an extension of and a variation of the game board that has been previously described.

Having thus described at least one illustrative embodiment of the invention, it is to be understood that although specific terms are employed, those terms are used in a generic and descriptive sense and not for the purpose of limitations to the scope of the invention being set forth in the following claims.

I claim:

1. A board game apparatus comprising a board acting as a playing field and a coloring implement, said board having permanently marked spaces constituting a path or course extending around the board, said path affording a continuous track for the purpose of continuity of play, an area of the board having an erasable surface and said erasable surface having permanently printed indicia defining boundaries for spatial regions on said erasable surface that are substantially lacking in color, and upon which a player may apply from said coloring implement color that can easily be removed after it is applied as the playing of a game progresses.

2. The board game apparatus of claim 1 wherein said coloring implement is a dry-erase marker, the applied color from which may be removed from said erasable surface by using a dry wiper.

3. The board game apparatus of claim 1 wherein said coloring implement is a wax crayon, the applied color from which may be removed from said erasable surface by using a dry wiper.

4. The board game apparatus of claim 1 wherein said coloring implement is a washable-ink marker, the applied color from which may be removed from said erasable surface by using a wiper that may be moistened with a solvent, including water.

5. The game board apparatus of claim 1 further comprising a separate sheet of paper-like material having permanently printed indicia defining boundaries for spatial regions that are substantially lacking in color, and upon which a player may apply color from said coloring implement as the playing of a game progresses.

6. The game board apparatus of claim 5 wherein said separate sheet of paper-like material has spatial regions comprising an erasable surface from which said color may easily be removed.

* * * * *